United States Patent [19]

Mathieu

[11] 4,170,429

[45] Oct. 9, 1979

[54] INSTALLATION FOR INSPECTING AND REPAIRING INSTALLATIONS IN DEEP WATER

[75] Inventor: Francis D. A. Mathieu, Nogent-sur-Marne, France

[73] Assignee: Compagnie Generale pour les Developpements Operationnels des Richesses Sous-Marines "C.G. Doris", Paris, France

[21] Appl. No.: 835,227

[22] Filed: Sep. 21, 1977

[30] Foreign Application Priority Data

Sep. 29, 1976 [FR] France ..... 76 29252
Feb. 15, 1977 [FR] France ..... 77 04204

[51] Int. Cl.[2] ..... E02B 15/02
[52] U.S. Cl. ..... 405/195; 405/185
[58] Field of Search ..... 61/86–94, 61/98, 100, 69 R, 68, 69 A; 114/264, 265, 222

[56] References Cited

U.S. PATENT DOCUMENTS

| | | | |
|---|---|---|---|
| 1,619,642 | 3/1927 | Ward | 61/68 |
| 2,019,059 | 10/1935 | Sherman | 61/69 R |
| 2,771,747 | 11/1956 | Rechtin | 61/89 |
| 3,189,093 | 6/1965 | De Vries | 114/265 X |
| 3,375,669 | 4/1968 | Garcia | 61/90 |
| 3,461,828 | 8/1969 | Bielstein | 61/80 X |
| 3,463,271 | 8/1969 | St. Louis | 61/69 R X |
| 3,698,197 | 10/1972 | Bodey et al. | 61/69 R X |
| 3,738,113 | 6/1973 | Madary et al. | 114/264 X |
| 3,766,737 | 10/1973 | Howard | 61/103 X |
| 3,863,393 | 2/1975 | Goff | 114/222 X |
| 3,984,944 | 10/1976 | Maasberg et al. | 114/222 X |
| 4,077,225 | 3/1978 | Lichtenberger et al. | 61/103 |

*Primary Examiner*—Dennis L. Taylor
*Attorney, Agent, or Firm*—Laurence R. Brown

[57] ABSTRACT

For inspecting and maintaining a submerged installation comprising an emergent part such as a platform, such as an artificial island or a submerged reservoir, said emergent part is equipped with a track along which a trolley associated with a diving bell can be circulated.

The track is preferably installed under the platform, above the portions of the infrastructure to be inspected.

5 Claims, 11 Drawing Figures

FIG. 1
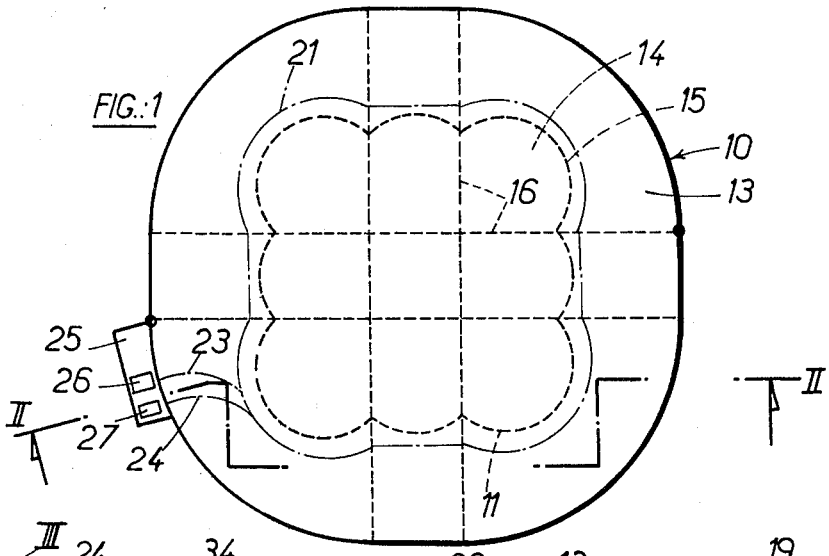
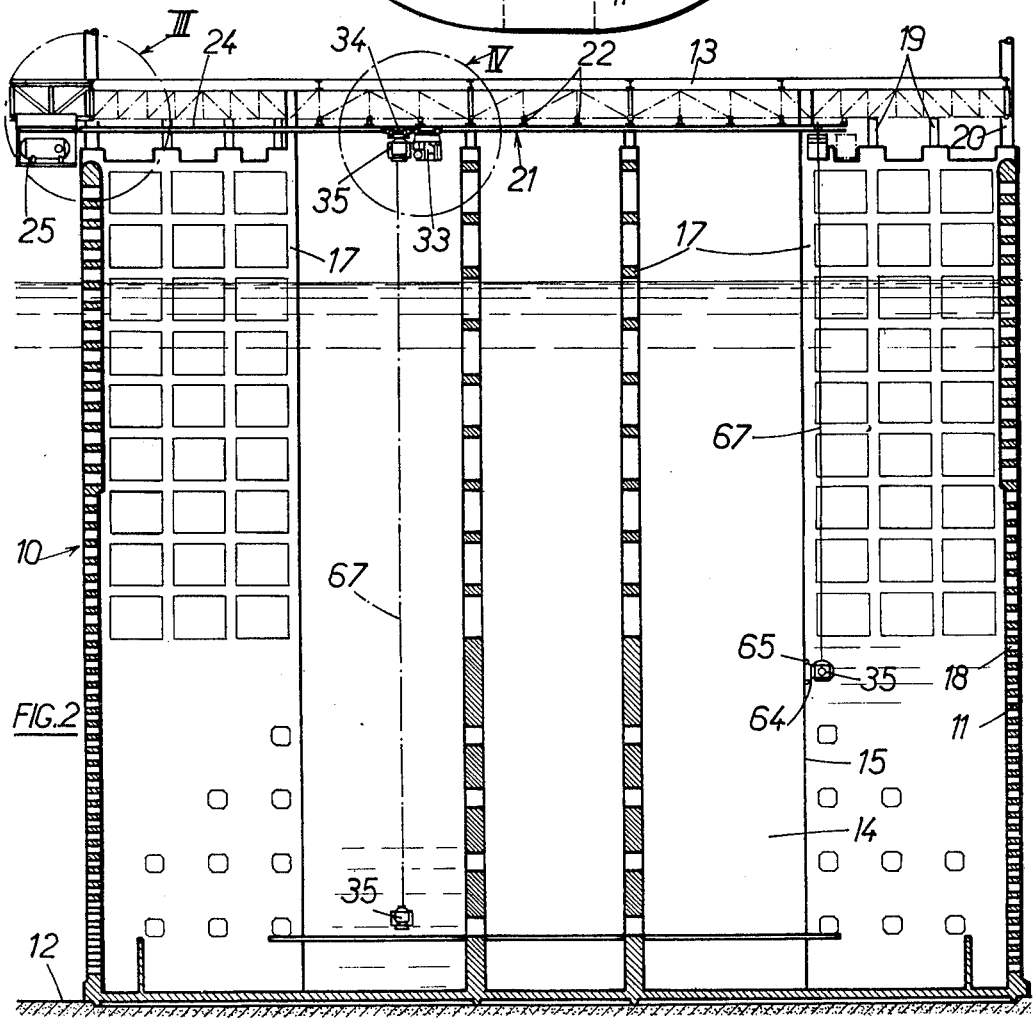
FIG. 2

INSTALLATION FOR INSPECTING AND REPAIRING INSTALLATIONS IN DEEP WATER

The present invention relates to installations installed in deep water, such as artificial islands and reservoirs which are used for exploiting under-water riches.

Such installations usually comprise an infrastructure, generally of reinforced concrete, of which the lower part is submerged and supports a superstructure housing a platform above the highest waters.

Some of these installations are of substantial size, of the order of 100 meters even in the horizontal direction as well as the vertical and their submerged portion has a relatively complicated structure particularly because of the necessity of providing protecting walls, stiffening diaphragms, etc.

The inspection and maintenance of installations of this type creates problems the more difficult because often the state of the sea prevents boats from being stationed near the installation and even in good weather, it is not always convenient, or even possible, with such boats to visit the under-water walls and carry out necessary repairs.

The essential object of the present invention is to create an installation with which an installation of the type described can be equipped with a view to facilitating the inspection, and if need be, the maintenance and repair of the infrastructure of said installation.

According to the invention, the emergent portion of the installation is equipped with a track, preferably encircling said installation, if appropriate, under the platform of the latter, along which can circulate a trolley associated with a diving bell than can be caused to descend opposite the walls to be visited.

This bell may contain observation instruments such as television cameras. It can also be occupied and is preferably adapted to allow the exit of divers, the installation also being equipped with the necessary material, notably a decompression station.

The trolley is advantageously driven by means of a motor tractor, the diving bell being preferably provided with means of propulsion enabling it, notably, to approach and move away from the walls to be inspected and maintained.

According to one embodiment, the diving bell comprises a ballast mounted by means of at least one hoisting machine and a line, such as a cable, enabling the ballast to be lowered beneath said bell.

One can thus, for example, rest the ballast on the bed or on any convenient place on the infrastructure, slacken the supporting cable as well as the umbilical cord of the bell, and displace the latter around the vertical axis of the ballast to which, it will be understood, it remains attached.

One can also increase the mobility of the bell by equipping it, still in accordance with the invention, with an auxiliary reservoir which can be purged by means of compressed air or other gas, so that it can act as a float when it is desired to reduce the apparent weight of the bell. The reservoir is preferably located above the latter and attached to the cage which protects it.

The following description with reference to the accompanying drawings, given by way of non-limiting example, will enable the method of carrying the invention into effect to be understood, the details of both the drawings and the text forming, it will be understood, part of said invention.

FIG. 1 is a diagrammatic plan view of a submerged installation of which the infrastructure, which forms a reservoir for hydrocarbons in its central part, carries a platform overlapping the reservoirs.

FIG. 2 is a section on a larger scale on the line II—II of FIG. 1.

Figure 3:
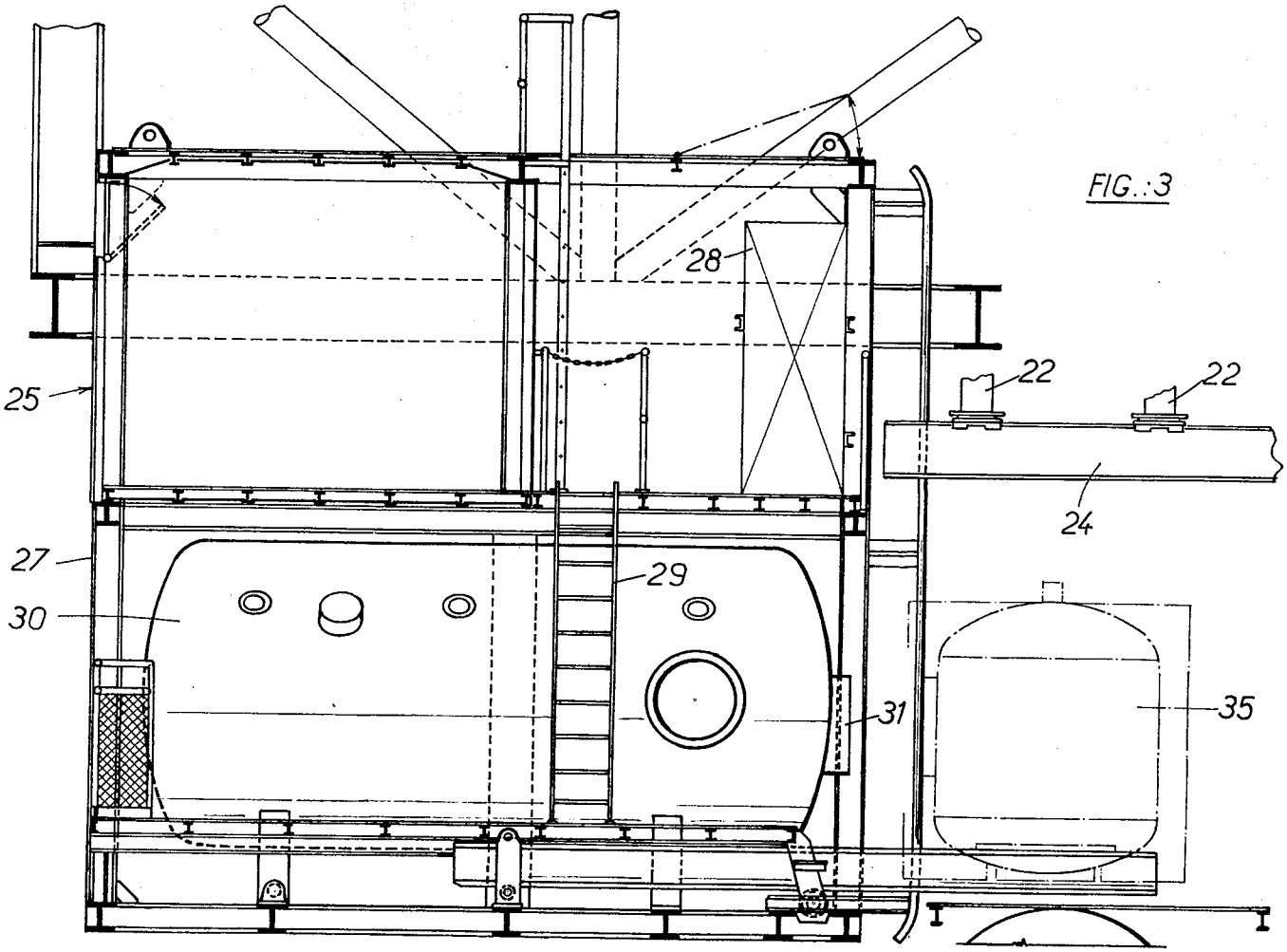
FIG. 3 is a vertical section of the decompression station of the track station.

In the embodiment shown in the drawing, a submerged installation 10 of known type comprises an infrastructure 11 which rests on the bed 12 of the sea, at a depth for example of a hundred meters (FIG. 2) and supports a platform 13, at a height for example of fifteen to twenty meters above the average water level.

The infrastructure comprises, in its central part, a reservoir 14 formed of cells of which the external walls 15 are lobed and the internal walls 16 disposed as a double cross (FIG. 1), the walls 16 being continued beyond the reservoir to form perforated diaphragms 17 (FIG. 2) which extend to an external breakwater 18 surrounding the installation and perforated to allow the passage of water while dissipating its energy.

The platform 13 is carried by the reservoir as well as by columns 19 and 20 built on the diaphragms 17 and the wall 18 (FIG. 2).

It can be imagined that an installation of this size, installed in seas that are often turbulent, requires constant inspection and maintenance and that it is inconvenient, if not impossible, to install and service from a boat the material required to inspect the internal faces of the wall and the diaphragms as well as that of the external face of the reservoir.

According to the invention, there is installed under the platform 13 a circulation track 21, comprising for example a monorail attached to suspenders 22 and capable of circling the reservoir 14 at some distance from the external walls 15 thereof, so as to reach all the places that it is desired to inspect and service. The track 21 comprises two branches 23 and 24 (FIG. 1) leading to a station 25 installed at the edge of the platform 13. This station comprises (FIG. 1) a siding 26 to which the branch 23 leads and a decompression station 27, served by the branch 24 and which is shown in more detail in FIG. 3. Also shown on this figure is an upper building in two parts equipped with gas reservoirs 28 and from which one can descend by a ladder 29 to reach a decompression chamber 30 installed under said building and of which the entry lock opens towards the branch 24. This chamber can be of any known type.

Figure 4:
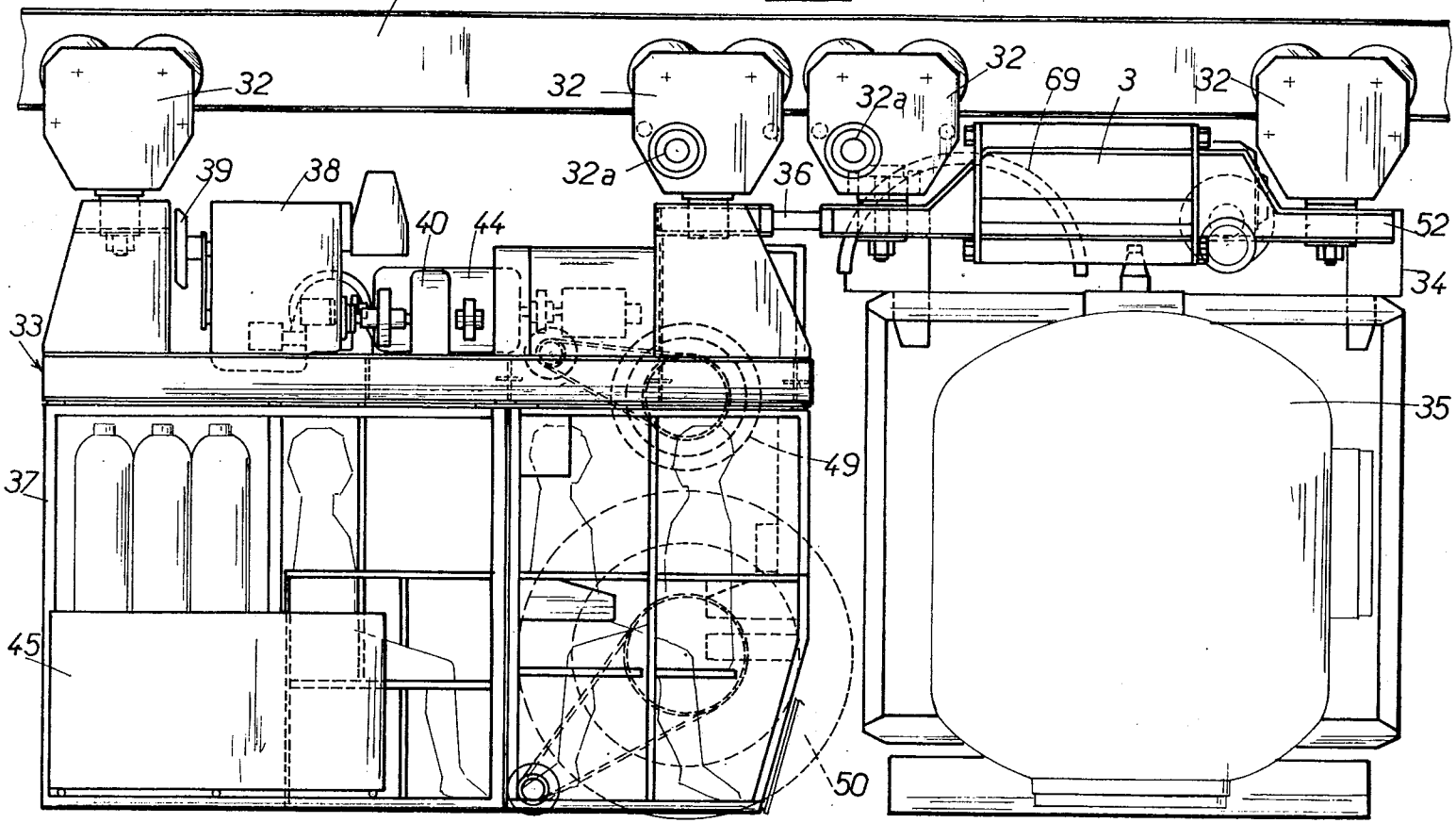
FIG. 4 is a diagrammatic view, in longitudinal elevation, of the motor tractor and of the winch to which the diving bell is attached.
Figure 5:
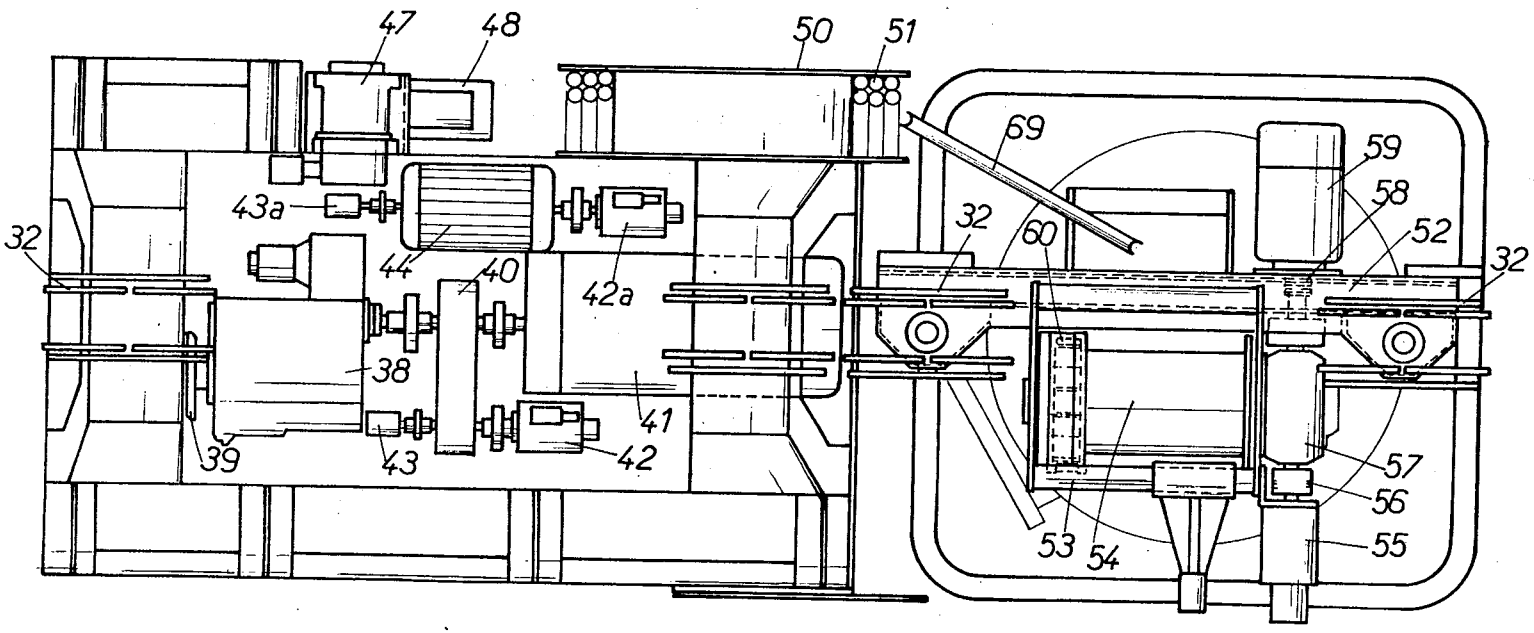
FIG. 5 is a corresponding plan view.

From the monorail 21 is suspended, by means of bogies 32, a train consisting of a motor tractor 33 and a winch trolley 34 which carries a diving bell (FIGS. 4 and 5).

As shown in FIG. 4, these machines are connected by a coupling 36 connected to the pivots of their respective adjacent bogies which are equipped with auxiliary hydraulic motors 32*a*.

The motor tractor comprises a cabin 37 with several places, equipped with a pilot station and containing bottles of gas, as well as the different instruments required for the task of the installation: electric and hydraulic control panels, videophone, magnetophone, etc.

The machinery is installed on the roof of the cabin. It comprises particularly a diesel motor 38 connected through a reduction gear 39 to one of the bogies 32 and via a transmission box 40 to an alternator 41, a variable output pump 42 and a constant output pump 43 (FIG. 5).

Two pumps 42*a* and 43*a*, respectively similar to the preceding ones, are coupled to a relief electric motor 44 fed by a battery of accumulators 45 housed in the cabin 37.

Also on the roof of the cabin is an hydraulic motor 46 which can drive a winch 47 for lowering and raising a lifeboat 48 (FIG. 5).

A motorised bobbin 49 corresponds to this lifeboat as can be seen in FIG. 4 and the "umbilical cord" for said lifeboat is wound thereon, said cord comprising particularly a tube of compressed gas, electric and telephonic conductors, a safety cable, etc.

A motorised bobbin 50 is also mounted laterally on the motor tractor, said bobbin being similar to the bobbin 49 and intended for the umbilical cord 51 of the diving bell (FIG. 5).

The trolley 34 comprises a support 52 to which is joined two bogies 32 and on which is mounted a guide 53 for the lowering and raising of the diving bell. This support also carries a winch 54 normally driven by an hydraulic motor connected by a coupling 56 to the reduction gear 57 of the trolley. The reduction gear is also connected, by an electric coupling 58, to a relief electric motor 59 fed by the battery 45.

The winch is equipped with a brake 60 (FIG. 5).

Figure 6:
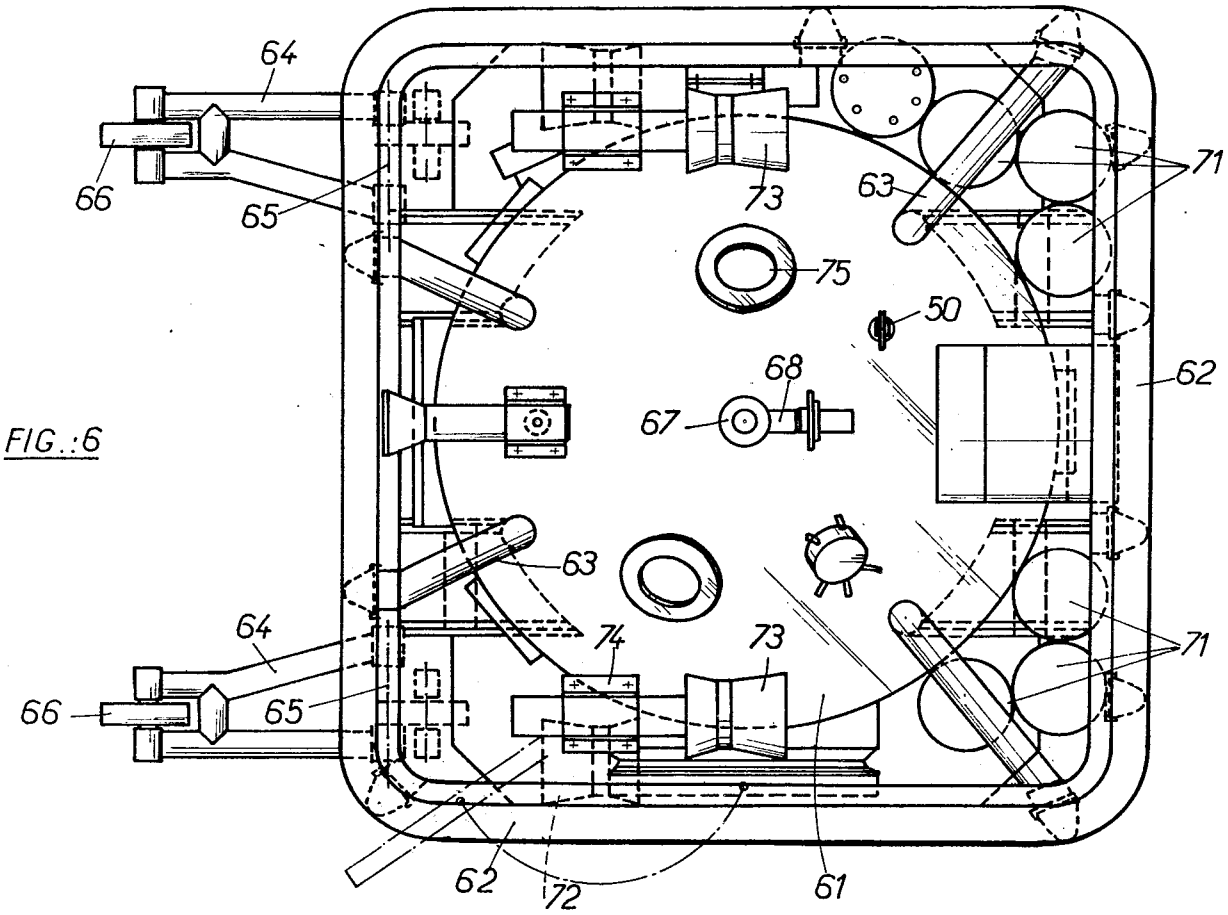
FIG. 6 is a plan view of the diving bell.

The diving bell 35 comprises a fluid-tight chamber 61 surrounded and protected by a cage 62, substantially cubical, to which it is fixed by arms 63. The cage 62 is provided on one of its side faces with four displaceable arms 64 respectively pivoted at one end to a horizontal axle 65 and provided at the other end with a roller (FIGS. 6 to 8).

Figure 7:
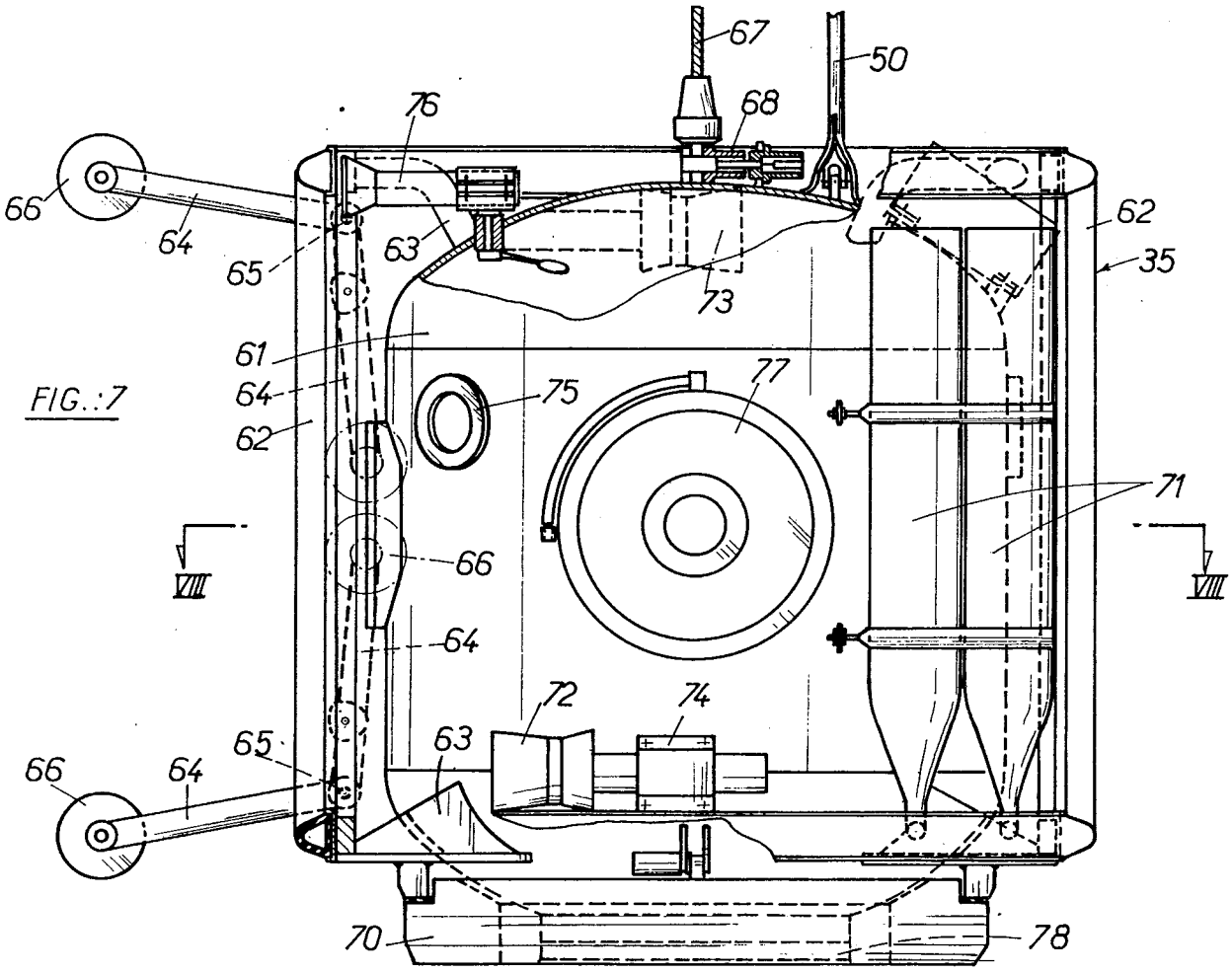
FIG. 7 is a side elevation with partial removal of said bell.
Figure 8:
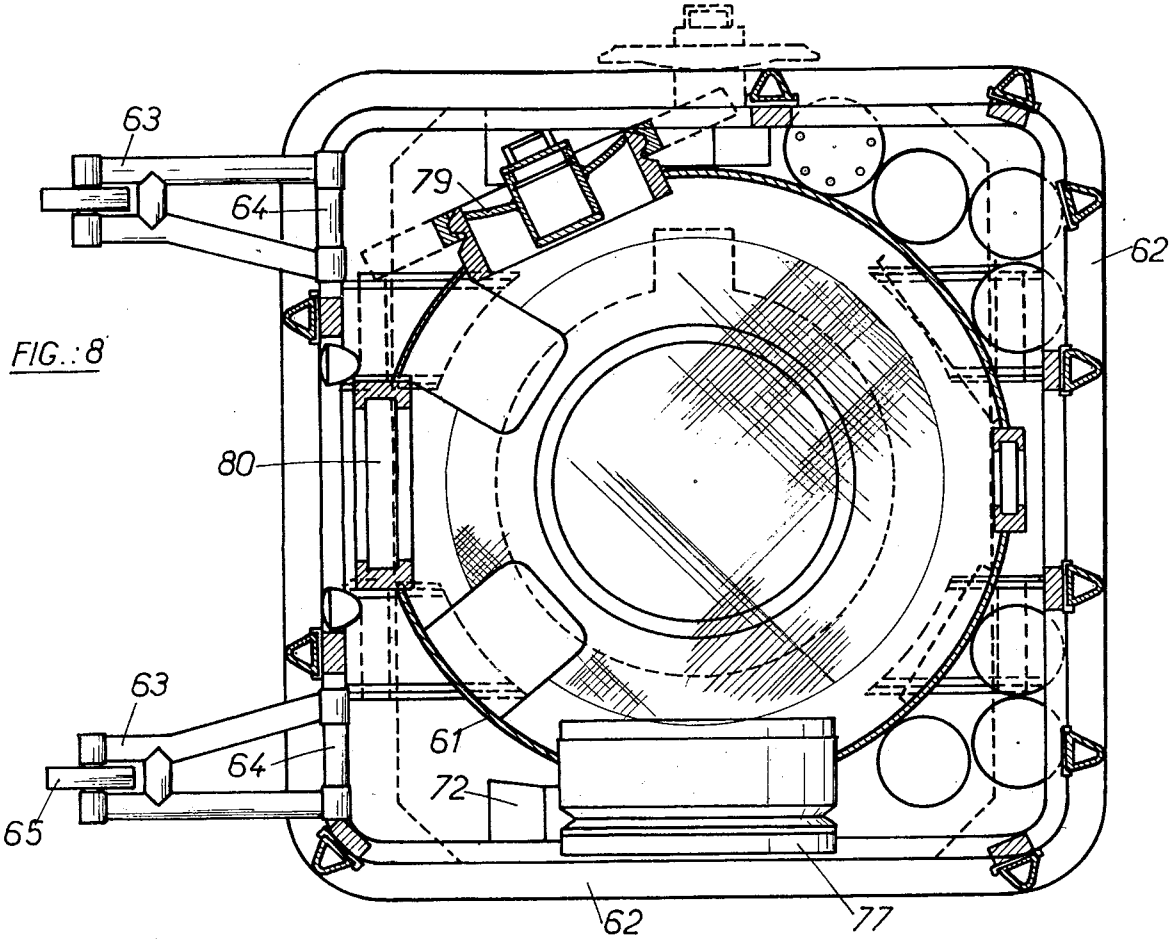
FIG. 8 is a section on the line VIII—VIII of FIG. 7.

These arms can be pushed out to a substantially divergent position or folded back to the interior of the cage, against the chamber, as shown in broken lines in FIG. 7. The bell 35 is suspended by the cable 67 from the winch 54 by an attachment device 68 provided with a release system. It is also connected to the umbilical cord 51 which, as shown in FIG. 5, is led towards the winch 54 by a guide 69.

The cord 51 comprises, inter alia, a tube for feeding compressed gas and electric, telephone and television conductors.

Externally, the bell comprises a releasable ballast 70 (FIG. 7), relief bottles of gas 71 and reaction propellers 72 and 73, for example four in number, fixed to the chamber 61 by means of supports 74. The propellers 72 are situated at the lower part of the chamber and the propellers 73 at the upper part. These propellers are mutually parallel and substantially parallel to the arms 64 when the latter are pushed out. They are directed in pairs in opposite directions as can be seen particularly from FIGS. 6 and 7.

The chamber is equipped with portholes 75, a swivelling television camera 76, a side door 77 and a lower door 78 both with two pressure panels, a relief door 79 with a simple panel, and an observation window opening between the arms 64 (FIG. 8).

Internally, the chamber 61 is equipped with the material necessary for its control, observation, and descent.

The installation above described can be used as follows:

Normally, the side station 25, in which the different machines are parked, is under the shelter of the platform 13 but, when it is desired to use the installation, it is located opposite the branches 23 and 24.

Two divers equip the diving bell 35 and a third remains in reserve to use the lifeboat 48.

The pilot of the motor tractor 33 moves this machine, with the trolley 34 and the diving bell mounted therein, along the track 21 to arrest the whole above the place where the inspection is to be made (FIG. 2).

The bell 35 is then lowered, the divers regulating the pressure therein to that of the atmosphere and extending the arms 64. By using the propellers 72 and 73, the divers manoeuvre the bell and move it so that the rollers 65 of the arms 64 are applied against the wall to be inspected, as shown for example on the right of FIG. 2.

It is possible, in practice, to move the bell to face all the surfaces of the compartments comprises between the external walls 15 of the reservoir, the diaphragms 17 and the protecting wall 18. One can also inspect the walls that are oblique or curved in the horizontal or vertical direction, for example when infrastructures are involved which comprise an enlarged base connected by curved or inclined walls to a central shaft, or on the other hand walls which diverge upwards. The mobility, relative independence and manoeuvrability of the bell allow all these thing to be done.

Normally, the divers inspect the walls through the portholes and the observation window of the bell and they can record what they see by means of a television camera and a video-recorder. They thus remain under atmospheric pressure and can leave the bell when the latter has been raised and returned to the station 25.

If it is necessary to carry out work, the divers put the bell under pressure, which takes several minutes. One of them leaves the bell and the other remains in reserve. When the work is finished, or at the end of the maximum passage of exit time, the diver re-enters the bell and closes it and the bell is then raised still under pressure to place it at the end of the branch 24 opposite the decompression chamber 30 the lock 31 of which is connected to the door 77 of the bell.

When the divers are installed in the decompression chamber 30, the bell can be detached and the train returned to the park.

Although all the normal operations may be carried out in the bell, with air or a special breathing mixture, the relief diver remains ready to intervene with the lifeboat 48 if need be.

Figure 9:
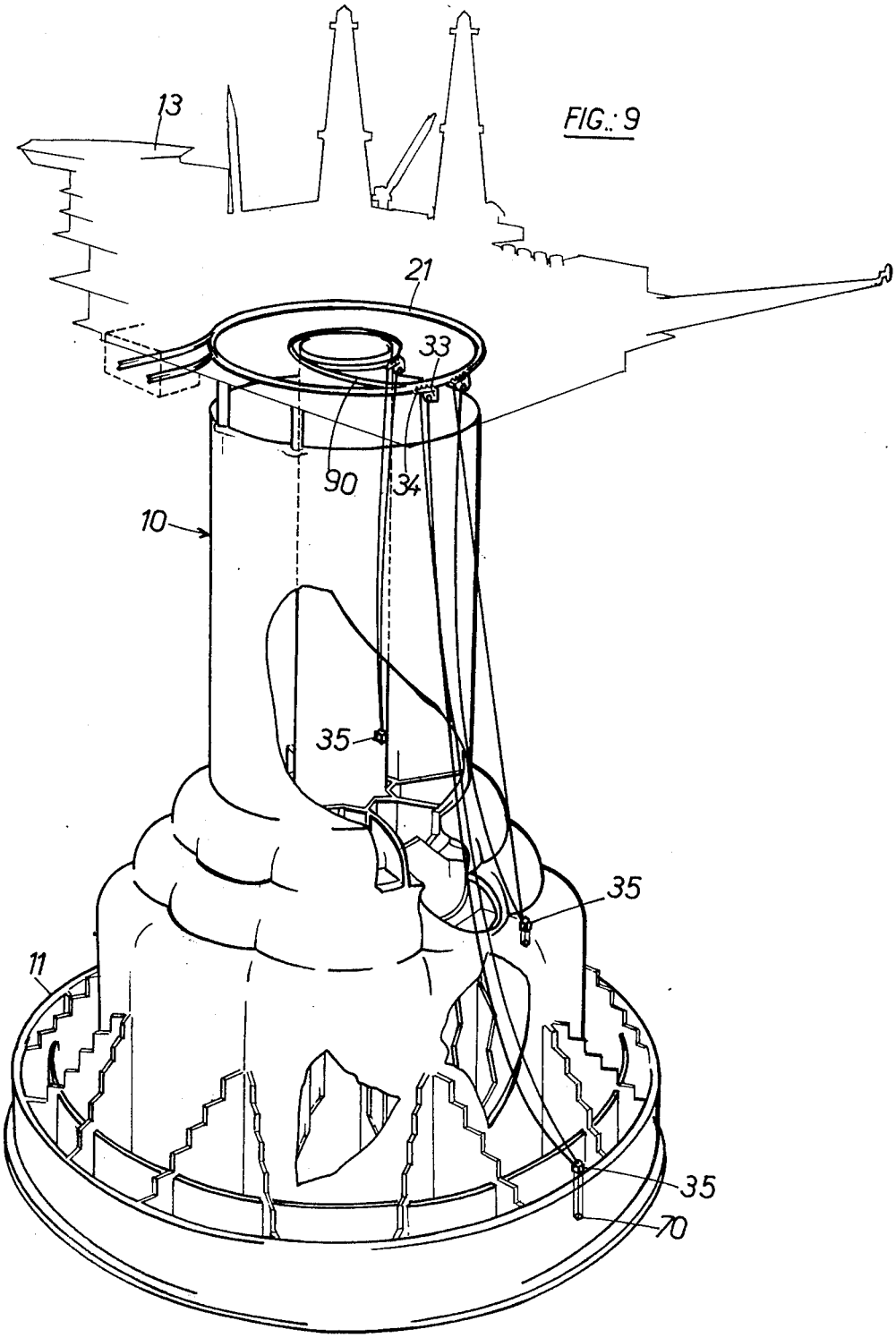
FIG. 9 is a diagrammatic perspective view of an installation equipped with an improved inspection and maintenance installation according to a variant.

As shown in FIG. 9, the infrastructure 11 of the installation 10 has a relatively complicated form due particularly to the presence of an enlarged base, stepped buttresses and a double peripheral base wall.

The circulation track, from which are suspended the motor tractor 33 and the winch trolley 34, here comprises two circular portions connected by a bitangential crossover. Several motor tractors equipped with their diving bell are shown better to illustrate the functioning of the installation.

Figure 10:
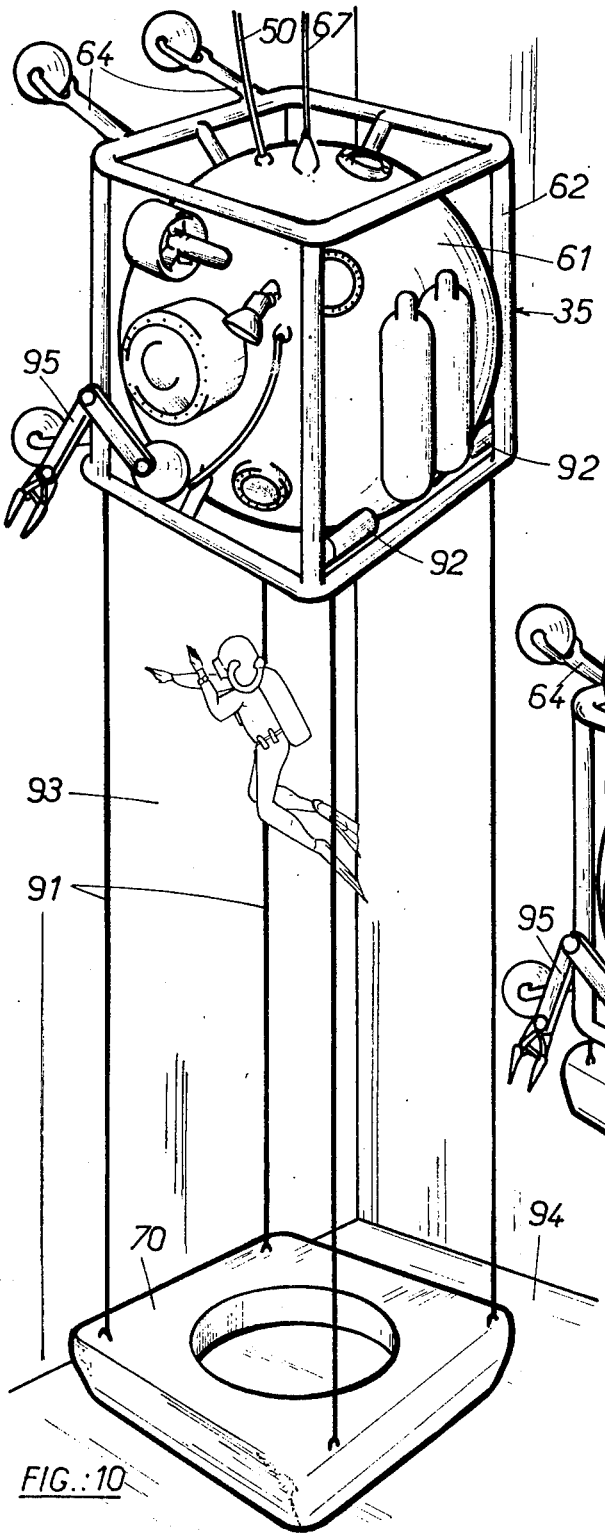
FIG. 10 shows, similarly, the bell attached to its ballast resting on the bed.

As can be seen best in FIG. 10, the ballast 70 of the diving bell 35 is suspended from the latter by means of cables 91 and winches 92 mounted on the cage 62 which protects the chamber of the bell. One can thus bring the ballast against the bell or allow it to descend therebeneath, the winches being controllable from the inside of the cabin by a suitable transmission, not shown.

When it is desired, for example, to inspect a wall 93 situated at the base of the installation 10, the motor tractor 33 is stopped at the desired place on the outer loop of the track 21, then the bell 35 is lowered by actuating its propellers 72 and 73, so that it moves away from the installation and is applied against said wall by its arms 64.

The ballast 70 can then be lowered until it rests on the soil 94 at the foot of the wall 93, as shown in FIG. 10. The carrying cable 67 and the umbilical cord 50 can then be slackened and the diving bell then behaves somewhat like a captive balloon which can be made to rise and fall and move along the wall by using the winches 92 and the propellers 72 and 73.

An articulated arm 95 can be provided for enabling certain operations to be carried out.

Figure 11:
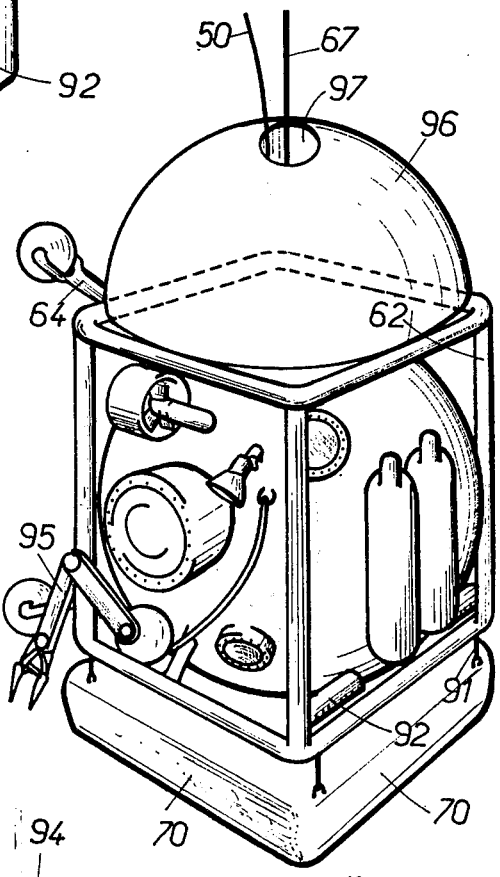
FIG. 11 shows, also in diagrammatic perspective, a bell equipped with an auxiliary reservoir-float.

As shown in FIG. 11, the mobility of the bell can be increased by mounting a reservoir 96 on the cage 62, for example of substantially hemispherical form, which can be filled with water when the bell is lowered but which can be purged and filled with compressed air, for example from bottles 71, to enable it to act as an auxiliary float.

The reservoir 96 is pierced in the middle with a vertical passage allowing the carrying cable 67 and the umbilical cord 50 to reach the chamber 61. It is provided with emptying and drainage valves, not shown.

It goes without saying that the embodiment described is only an example and could be modified, particularly by the substitution of technical equivalents, without departing from the scope of the invention.

I claim:

1. An installation comprising an infrastructure the lower part of which is submerged and a superstructure located above the water, the combination of a track arranged on said superstructure, a trolley adapted to be moved along said track, a diving bell suspended from said trolley, means on said trolley for lowering and raising said diving bell adjacent the submerged part of said infrastructure for inspection, a motor tractor on said track adapted to be coupled to said trolley, a motorized bobbin on said tractor, an umbilical cord attached to said bobbin and to said diving bell, a winch on said trolley associated with said diving bell for lowering and raising said bell, means on said trolley for driving said winch in synchronism with said bobbin, a winch on said motor tractor, a life boat attached to said winch, a second motorized bobbin on said tractor, an umbilical cord attached to said second bobbin and to life boat, said motor tractor comprising a machinery comprising a diesel engine, an electric generator and pumps driven by said engine, hydraulic motors fed by said pumps for driving said bobbins and winches, an electric relief motor adapted to drive said pumps in case of failure of said diesel engine and battery means for feeding said electric relief motor.

2. An installation comprising an infrastructure the lower part of which is submerged and a superstructure located above the water, the combination of a track arranged on said superstructure, a trolley adapted to be moved along said track, a diving bell suspended from said trolley, means on said trolley for lowering and raising said diving bell adjacent the submerged part of said infrastructure for inspection, said diving bell being provided with mutually parallel propellers and with arms attached at one end to said bell and provided at the other end with rollers for contacting the part of said infrastructure to be inspected, said arms being movable from a position substantially parallel to said propellers to a position retracted along said diving bell, whereby said bell can be moved along and in contact with said part of said infrastructure while remaining suspended to said trolley.

3. An installation as claimed in claim 2 wherein said part of said infrastructure to be inspected has an enlarged base, said diving bell being provided with a ballast suspended from said bell and with hoisting means for lowering and raising said ballast, whereby said diving bell can be lowered in front of said enlarged base, said ballast can be laid down on a stationary place, the suspension means of said diving bell slackened and said diving bell moved with respect to said base by means of said propellers and hoisting means.

4. An installation as claimed in claim 3 wherein said bell is enclosed within a protecting cage, said ballast being suspended to said cage by means of winches and cables.

5. An installation as claimed in claim 4 wherein to said cage is secured an auxiliary reservoir, means being provided on said bell for filling said reservoir with water, for emptying said reservoir and filling it with compressed gas whereby the buoyancy of said diving bell can be adjusted.

* * * * *